United States Patent [19]

Hamilton et al.

[11] Patent Number: 4,981,000

[45] Date of Patent: Jan. 1, 1991

[54] PENETRATION OF POWER INSTALLED ANCHOR

[75] Inventors: Daniel Hamilton; J. Thomas Odom, both of Centralia, Mo.

[73] Assignee: A. B. Chance Company, Centralia, Mo.

[21] Appl. No.: 451,215

[22] Filed: Dec. 15, 1989

[51] Int. Cl.[5] ..... E02D 5/74; E21B 10/44; E21B 17/10

[52] U.S. Cl. ..... 52/157; 175/394; 175/408

[58] Field of Search ..... 175/394, 408; 52/157; 405/259

[56] References Cited

U.S. PATENT DOCUMENTS

| | | | |
|---|---|---|---|
| 269,548 | 12/1882 | Stephenson | 175/388 |
| 1,883,477 | 10/1932 | Bash | 52/157 |
| 3,387,674 | 6/1968 | Watson | 175/394 |
| 4,334,392 | 6/1982 | Dziedzic | 52/157 |
| 4,467,575 | 8/1984 | Dziedzic | 52/157 |

*Primary Examiner*—James L. Ridgill, Jr.

*Attorney, Agent, or Firm*—Hovey, Williams, Timmons & Collins

[57] ABSTRACT

An earth anchor apparatus adapted to be driven by a source of rotational driving force into unbroken soil includes a longitudinally extending hub having first and second axial ends. A recess is provided in one axial end of the hub by which the anchor may be driven, and a radially extending, load-bearing element is affixed to the hub between the axial ends. An earth engaging lead tip extends axially from the second end of the hub and includes a first cutting edge extending in a direction generally transverse to the longitudinal axis of the hub and arranged to cut into and break soil encountered thereby, a front surface extending between the hub and the first cutting edge, and a second cutting edge extending between the first cutting edge and the leading edge of the load bearing element. The second cutting edge is adapted to both cut soil and guide it from the first cutting edge toward the load-bearing element along the front surface so that as soil is cut it is moved away from the unbroken soil.

21 Claims, 2 Drawing Sheets

PENETRATION OF POWER INSTALLED ANCHOR

BACKGROUND OF THE INVENTION

1. Field of Invention

The present invention relates generally to earth anchors and, more particularly, to an earth anchor provided with a leading edge of increased strength and having a construction permitting improved earth penetration thus enabling installation of the anchor in dense or frozen soils.

2. Discussion of the Prior Art

It is known to provide a modular screw anchor having a lead point that assists the anchor in penetrating unbroken soil during installation. Such constructions are illustrated in U.S. Pat. Nos. 4,334,392 and 4,467,575, both to Dziedzic. Each of the known constructions includes a rod made up of a major elongated portion, an earth-penetrating lead, and a modular one-piece anchor member disposed on and operatively coupled to the rod.

In each of these known constructions, the lead is provided with an outwardly extending, circular shoulder which is adapted to engage a hub portion of the anchor member, and the earth-penetrating lead tip depends from the cirular shoulder in a direction away from the hub portion. As disclosed in the noted patents, the lead is in the form of an elongated element which is obliquely oriented relative to the longitudinal axis of the major portion of the rod and is beveled at its lower end to present a lowermost earth-cutting edge or tip.

Although these known constructions perform adequately under many frequently encountered conditions, it has been found that when installation of the anchor is attempted in frozen ground or in ground made up of stones and dense homogeneous earth, the anchor may be prevented from penetrating the earth beyond a certain point due to the resistance presented by the frozen or dense soil. Such a result is most notable in anchors of the type which are provided with hollow hubs adapted to be engaged by a wrench member that extends into the hub during installation of the anchor. In this type of anchor assembly, a relatively large bearing surface area is presented by the anchor due to the increased cross-sectional area of the hub of the anchor, and this increased bearing surface area causes an increase in the total resistance to pentration exerted on the anchor by the earth during installation. This increase in resistance is a primary cause of folding and collapsing of the leading edge of the helix of known anchor assemblies which causes the helix to close such that pentration of the earth by the assembly is impeded.

OBJECTS AND SUMMARY OF THE INVENTION

It is an object of the present invention to provide an anchor apparatus which is constructed to improve penetration of the anchor in frozen or relatively stony or dense homogeneous earth.

Further, it is an object of the invention to provide an anchor apparatus which includes means for removing soil from the region of the anchor tip and forces the soil radially outward and upward beyond the extent of the hub of the anchor apparatus so that the hub does not impede penetration of the anchor during installation.

According to the present invention, an earth anchor apparatus adapted to be driven by a source of rotational driving force into unbroken soil includes a longitudinally extending hub having first and second axial ends, means for attaching the anchor to the source of rotational driving force at the first end of the anchor, and a radially extending, load-bearing element affixed to the hub between the first and second axial ends, the load bearing element including a leading edge intersecting the hub and structure extending radially outward from the hub in a generally helical direction. An earth engaging lead tip extends axially from the second end of the hub, the lead tip including a first cutting edge extending in a direction generally transverse to the longitudinal axis of the hub and being arranged to cut into and break soil encountered thereby, a front surface extending between the hub and the first cutting edge, and a second cutting edge extending between the first cutting edge and the leading edge of the load bearing element, the second cutting edge being adapted to both cut soil and guide it from the first cutting edge toward the load-bearing element along the front surface so that as soil is cut it is moved away from the unbroken soil. In addition, the second cutting edge is arranged to reinforce and brace a leading edge of the load-bearing element against bending due to installation forces.

Preferably, the anchor apparatus is constructed such that the hub defines a circular area as it rotates about the longitudinal axis, and at least a portion of the second cutting edge extends beyond the circular area. By this construction, material cut and moved by the second cutting edge is forced radially outward and upward of the earth anchor apparatus beyond the hub to permit penetration of the hub into the earth. Further, the second cutting edge provides reinforcement of the leading edge of the load-bearing element so as to protect against bending of the edge under the forces exerted on the element during installation.

BRIEF DESCRIPTION OF THE DRAWING FIGURES

A preferred embodiment of the invention is discussed in detail below with reference to the attached drawing figures, wherein.

Figure 4:
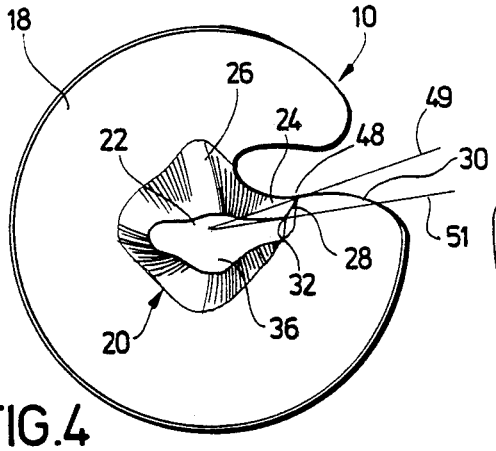
Figure 5:
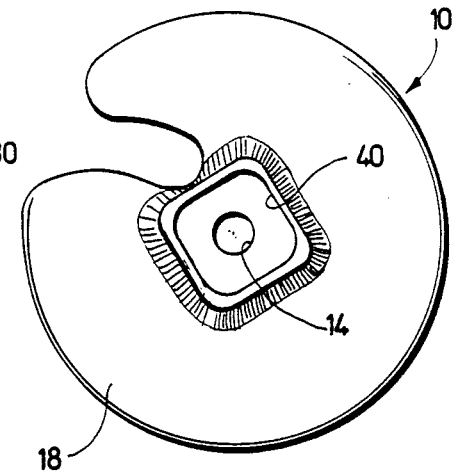
Figure 6:
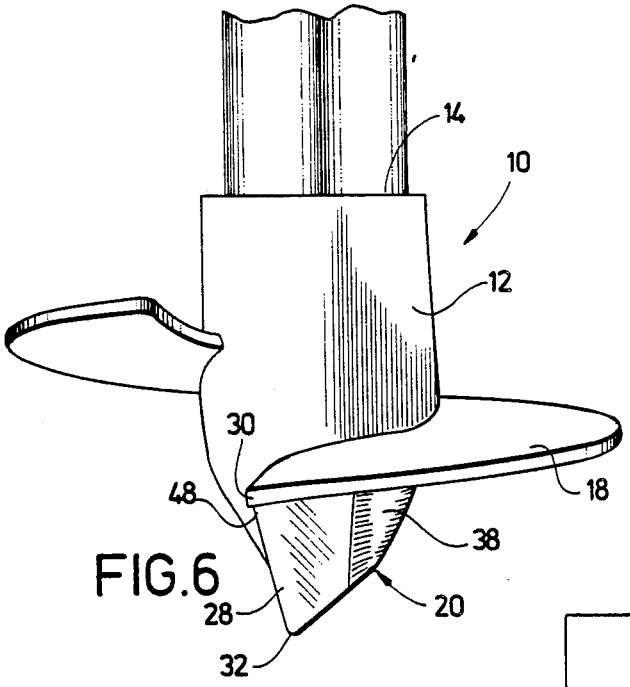
Figure 7:
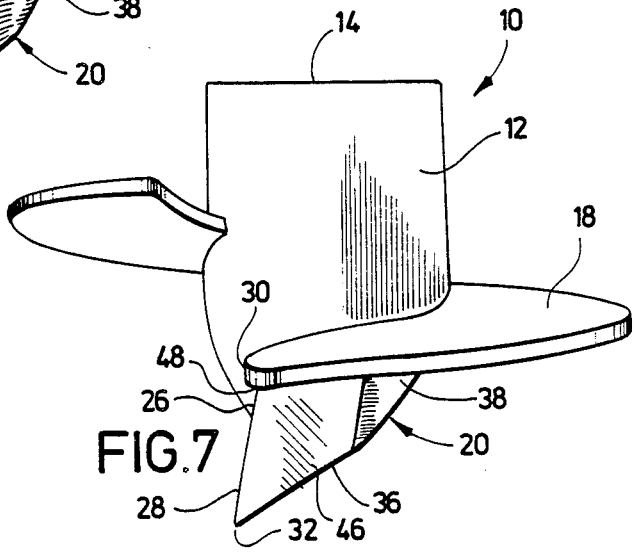

FIG. 4 a bottom plan view of the anchor apparatus;

FIG. 5 is a top plan view of the anchor apparatus;

FIG. 6 is a side elevation view of the anchor apparatus as mounted on a drive wrench; and FIG. 7 is a side elevation view of an alternate embodiment of the anchor apparatus.

DETAILED DESCRIPTION OF THE PREFERRED EMBODIMENT

Figure 1:
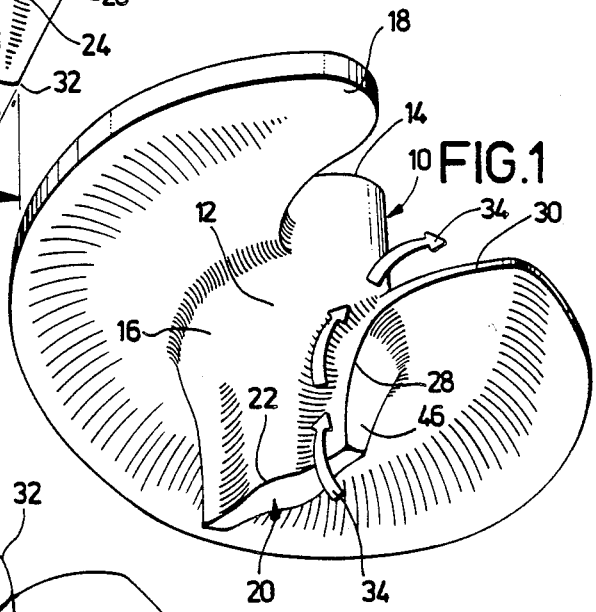
FIG. 1 is a perspective view of an anchor apparatus constructed in accordance with a preferred embodiment of the invention, illustrating the path that broken earth follows upon rotation of the anchor during installation.

An earth anchor apparatus 10 adpated to be driven by a source of rotational driving force into unbroken soil is illustated in FIG. 1, and includes a longitudinally extending hub 12 having first and second axial ends 14, 16 and a radially extending, load-bearing element 18 affixed to the hub. The load-bearing element 18 preferably includes a helical blade having a predetermined pitch, e.g. of 5 to 10 centimeters.

The first or upper end 14 of the hub 12 includes structure for permitting the anchor to be attached to a source of rotational driving force while the second or lower end 16 of the hub merges into an earth engaging lead tip 20. The lead tip extends axially from the second end of the hub and includes a first cutting edge 22 extending in a direction generally transverse to the longitudinal axis 21 of the hub and arranged to cut into and break soil encountered thereby. A front surface 24 of the lead tip 20 extends between the hub and the first cutting edge and includes a central ridge or raised area 26 providing a smooth transition between the hub, which includes a generally square cross-sectional shape, and the more flattened lead tip 20.

A second cutting edge 28 extends between the first cutting edge 22 and a leading edge 30 of the load bearing element 18. The second cutting edge 28 is adapted to both cut soil and guide it from the first cutting edge 22 toward the load-bearing element 18 along the front surface 24 so that as soil is cut it is moved away from the unbroken soil. The cutting edge 28 also connects to the load-bearing element 18 at a point radially outward of the hub 12 and provides reinforcement to the leading edge 30 of the element 18.

Figure 2:
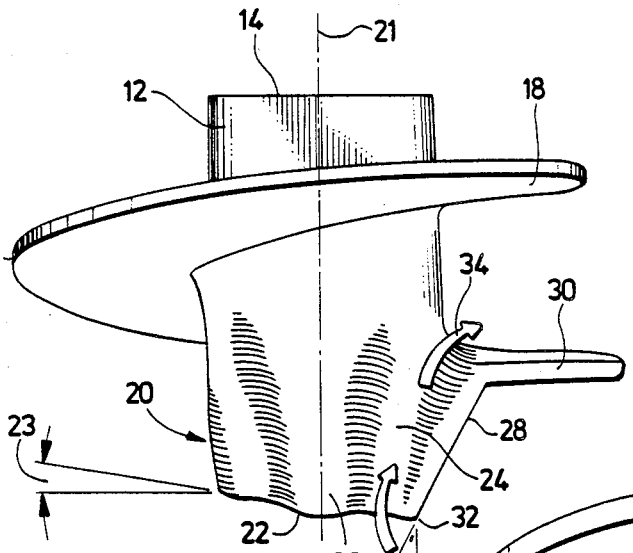
FIG. 2 is a side elevational view of the anchor apparatus illustrating the path that broken earth follows upon rotation of the anchor during installation.

As shown in FIG. 2, the first cutting edge 22 extends in a direction which is angled by an angle 23 relative to a plane extending in a direction perpendicular to the longitudinal axis 21 of the anchor; such that an apex 32 of the lead tip 20 is located at the point of intersection between the first cutting edge 22 and the second cutting edge 28. In this manner, during rotation of the anchor 10, cutting of the soil by the first edge 22 is primarily carried out by only the lower or righthand portion thereof as viewed in FIG. 4.

The second cutting edge 28 extends away from the apex 32 of the first cutting edge 22, as shown in FIG. 2, toward the leading edge 30 of the helical blade 18 and is angled by an angle 25 relative to the longitudinal axis of the hub such that a portion 27 of the second cutting edge extends beyond the hub. Although square in cross-section, the hub 12 defines a circular area as it rotates about the longitudinal axis, and the second cutting edge 28 is angled relative to the axis by the angle 25 which is sufficient to insure that at least the portion 27 of the second cutting edge extends beyond the circular area defined by the hub 12. In other words, the second cutting edge extends in a direction which is angled relative to the longitudinal axis of the hub such that the second cutting edge defines a truncated cone as it rotates about the longitudinal axis of the hub, and at least a portion of this truncated cone extends radially beyond the circumference defined by the circular path formed by rotation of the hub. By constructing the second cutting edge in this way, material is cut and cleared from beneath the anchor to a distance beyond the hub as shown by the arrows 34 to permit penetration of the hub into the earth during installation of the anchor. The construction also allows for reinforcement of the leading edge 30 of the element 18 to help prevent the element 18 from being bent during installation.

Figure 3:
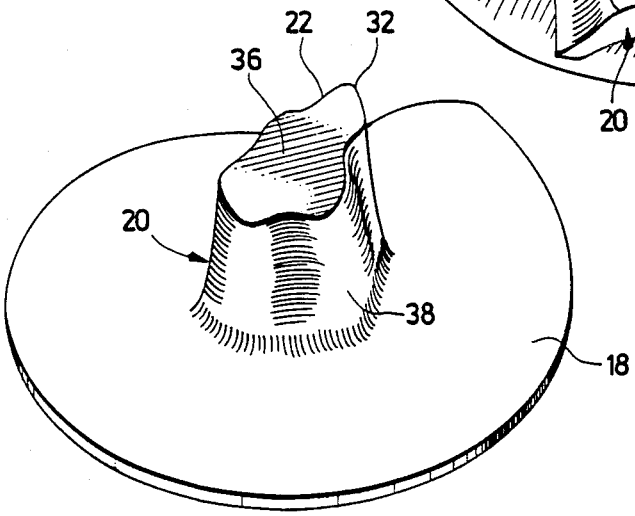
FIG. 3 is a perspective view of the anchor apparatus.

As illustated in FIG. 3, the first cutting edge 22 is backed up by a relief surface 36 which angles away from the edge relative to a plane extending in a direction perpendicular to the longitudinal axis of the hub 12. This relief surface 36 is provided to improve the cutting action of the edge 22 and to eliminate any flat horizontal bearing surfaces that would tend to impede the penetration of the anchor 10 during installation. A rear surface 38 of the lead tip extends between the relief surface 36 and the hub 12, and is shaped to provide a smooth transition between the square hub and the generally flattened lead tip 20.

The orientation of the first cutting edge 22 relative to the hub is shown in FIG. 4, where it can be seen that the transition between the first cutting edge and the hub includes no flat horizontal areas which would catch up on unbroken soil during installation of the anchor. In addition, the first cutting edge 22 extends across a portion of the diagonal width of the cross-sectional area of the hub so that the edge cuts the largest possible amount of earth from directly beneath the hub during rotation of the anchor in the counterclockwise direction as shown in the figure.

Although it is possible to form the anchor with a first cutting edge that extends beyond the area defined by the cross-section of the hub, such a construction is not preferred since it is possible to provide adequate cutting and clearing of soil directly beneath the hub by employing the illustated combination of first and second cutting edges 22, 28 which together clear a sufficient amount of soil from beneath the hub to permit passage thereof.

The means for permitting attachment of the anchor 10 to a source of rotational driving force is shown in FIG. 5, and includes a recess 40 in the hub that is shaped to receive a rectangular drive wrench 42 such as that shown in FIG. 6. As illustated in FIG. 5, a central threaded bore 44 is formed in the hub within the recess and is adapted to receive a threaded bar (not shown) that remains connected to the anchor after the anchor has been installed.

As shown in FIG. 6, the second cutting edge 28 is also provided with a relief surface 46 extending away from the second edge at an angle relative to a plane which includes the second cutting edge 28 and which extends in a direction tangential to the circumference of the truncated cone formed by the second cutting edge as it rotates about the axis of the hub. By angling the relief surface 46 in this direction, the cutting action of the second edge 28 is improved.

In addition to being angled away from the longitudinal axis of the hub in the direction noted above, the second cutting edge 28 is also angled relative to the longitudinal axis by a predetermined lead angle which is defined by projecting the second edge 28 radially onto the longitudinal axis. By angling the edge in this direction, a point 48 of intersection between the second cutting edge 28 and the helical blade 18 is defined on a radial line 49 extending outward from the longitudinal axis 21, and this point 48 leads the apex 32 during rotation of the anchor about the longitudinal axis. The apex may also be defined as a point provided on a radial line 51 extending outward from the longitudinal axis 21. In an alternate embodiment of the invention shown in FIG. 7, the direction of the angle formed by the second cutting edge 28 when projected radially onto the longitudinal axis may be reversed such that the apex 32 leads the point 48 during rotation of the anchor to further facilitate the movement of soil around the hub 12 and over the load-bearing element 18.

Regardless of the specific angle chosen, the object of providing the angled edge is to present the edge 28 to the earth during rotation of the anchor 10 in an orientation which expedites the removal of soil from adjacent the first and second cutting edges 22, 28 and which will deliver the soil to a side of the helical blade 18 opposite the lead tip 20.

During installation of the anchor, as shown in FIG. 1, the anchor is rotated in a counterclockwise direction such that the lead tip is first presented to unbroken earth along the edges adjacent the point of intersection therebetween. As the unbroken earth is cut by the edges, the soil broken from the earth is carried along the front surface of the lead tip toward the upper surface of the helical blade. The first and second cutting edges work together to cut enough soil from the unbroken earth to permit passage of the hub of the anchor without permitting any dead spots to form which would impede penetration of the anchor into the soil and the second cutting edge braces the leading edge 30 of the load-bearing element 18 against bending forces exerted on the element by the earth during installation. By providing this arrangement, the anchor may be installed in soils which, in the past, have presented problems to installation efforts. For example, the present construction permits the anchor to be driven into frozen soil or into stony soil or dense homogeneous earth.

Although the invention has been described with reference to the illustated preferred embodiment, it is noted that changes may be made and equivalents employed herein without departing from the scope of the invention as set forth in the appended claims.

What is claimed is:

1. An earth anchor apparatus adapted to be driven by a source of rotational driving force into unbroken soil, the apparatus comprising:

a longitudinally extending hub having first and second axial ends;

means for attaching the anchor to a source of rotational driving force at the first end of the anchor;

a radially extending, load-bearing, element affixed to the hub between the first and second axial ends, the load-bearing element including a leading edge intersecting the hub and structure extending radially outward from the hub in a generally helical direction; and an earth engaging lead tip extending axially from the second end of the hub, the lead tip including a first cutting edge extending in a direction generally transverse to the longitudinal axis of the hub and being arranged to cut into and break soil encountered thereby, a front surface extending between the hub and the first cutting edge, and a second cutting edge extending between the first cutting edge and the leading edge of the load-bearing element, the second cutting edge being adapted to both cut soil and guide it from the first cutting edge toward the load-bearing element along the front surface so that as soil is cut it is moved away from the unbroken soil.

2. The earth anchor apparatus as recited in claim 1, wherein the first cutting edge extends in a direction which is angled relative to a plane extending in a direction perpendicular to the longitudinal axis of the anchor.

3. The earth anchor apparatus as recited in claim 1, wherein the second cutting edge extends in a direction which is angled relative to the longitudinal axis of the hub such that the second cutting edge defines a truncated cone as it rotates about the longitudinal axis of the hub.

4. The earth anchor apparatus as recited in claim 1, wherein the second cutting edge contacts the first cutting edge at a point located on a first radial line relative to the longitudinal axis and contacts the load-bearing element at a point located on a second radial line relative to the longitudinal axis, the second cutting edge being angled relative to the longitudinal axis by a predetermined lead angle when projected radially onto the longitudinal axis such that the first radial line leads the second radial line during rotation of the anchor about the longitudinal axis.

5. The earth anchor apparatus as recited in claim 1, wherein the second cutting edge contacts the first cutting edge at a point located on a first radial line relative to the longitudinal axis and contacts the load-bearing element at a point located on a second radial line relative to the longitudinal axis, the second cutting edge being angled relative to the longitudinal axis such that the first radial line trails the second radial line during rotation of the anchor about the longitudinal axis.

6. The earth anchor apparatus as recited in claim 1, wherein the hub includes generally polygonal cross-sectional shape.

7. The earth anchor apparatus as recited in claim 1, wherein the hub includes a generally square cross-sectional shape.

8. The earth anchor apparatus as recited in claim 1, wherein the means for attaching the anchor to a source of rotational driving force includes a recess in the first axial end of the hub, the recess having a polygonal shape.

9. The earth anchor apparatus as recited in claim 1, wherein the lead tip includes a relief surface located opposite the front surface relative to the first cutting edge, the relief surface defining a plane that is angled relative to a plane which is perpendicular to the longitudinal axis.

10. The earth anchor apparatus as recited in claim 1, wherein the hub defines a circular area as it rotates about the longitudinal axis, at least a portion of the second cutting edge extending beyond the circular area such that material cut and moved by the second cutting edge is forced radially outward of the earth anchor apparatus beyond the hub to permit penetration of the hub into the earth.

11. The earth anchor apparatus as recited in claim 10, wherein the first cutting edge extends in a direction which is angled relative to a plane extending in a direction perpendicular to the longitudinal axis of the anchor.

12. An earth anchor apparatus adapted to be driven by a source of rotational driving force into unbroken soil, the apparatus comprising:

a longitudinally extending hub having first and second axial ends;

means for attaching the anchor to a source of rotational driving force at the first end of the anchor;

a load-bearing helix element affixed to the hub between the first and second axial ends, the helix element including a leading edge intersecting the hub and extending radially outward from the hub in a generally helical direction; and an earth engaging lead tip extending axially from the second end of the hub, the leading tip including;

a first cutting edge extending in a direction generally transverse to the longitudinal axis of the hub and being arranged to cut into and break soil encountered thereby, a second cutting edge extending between the first cutting edge and a predetermined point on the leading edge of the helix element which is located radially outward from the hub, and a front surface extending between the leading edge of the helix element and the first and second cutting edges, wherein the lead tip defines a radially extending support means extending along the leading edge of the helix element to the predetermined point thereon for supporting the leading edge of the helix element against bending forces exerted on the helix element during installation.

13. The earth anchor apparatus as recited in claim 12, wherein the hub defines a circular area as it rotates about the longitudinal axis, at least a portion of the second cutting edge extending beyond the circular area such that material cut and moved by the second cutting edge is forced radially outward of the earth anchor apparatus beyond the hub to permit penetration of the hub into the earth.

14. The earth anchor apparatus as recited in claim 12, wherein the first cutting edge extends in a direction which is angled relative to a plane extending in a direction perpendicular to the longitudinal axis of the anchor.

15. The earth anchor apparatus as recited in claim 12, wherein the second cutting edge extends in a direction which is angled relative to the longitudinal axis of the hub such that the second cutting edge defines a truncated cone as it rotates about the longitudinal axis of the hub.

16. The earth anchor apparatus as recited in claim 12, wherein the second cutting edge contacts the first cutting edge at a point provided on a first radial line relative to the longitudinal axis and contacts the helix element at a point provided on a second radial line relative to the longitudinal axis, the second cutting edge being angled relative to the longitudinal axis by a predetermined lead angle when projected radially onto the longitudinal axis such that the first radial line leads the second radial line during rotation of the anchor about the longitudinal axis.

17. The earth anchor apparatus as recited in claim 12, wherein the second cutting edge contacts the cutting edge at a point provided on a first radial line relative to the longitudinal axis and contacts the helix at a point provided on a second radial line relative to the longitudinal axis, the second cutting edge being angled relative to the longitudinal axis by a predetermined lead angle when projected radially onto the longitudinal axis such that the first radial line trails the second radial line during rotation of the anchor about the longitudinal axis.

18. The earth anchor apparatus as recited in claim 12, wherein the hub includes a generally polygonal cross-sectional shape.

19. The earth anchor apparatus as recited in claim 12, wherein the hub includes a generally square cross-sectional shape.

20. The earth anchor apparatus as recited in claim 12, wherein the means for attaching the anchor to a source of rotational driving force includes a recess in the first axial end of the hub, the recess having a polygonal shape.

21. The earth anchor apparatus as recited in claim 12, wherein the lead tip includes a relief surface located opposite the front surface relative to the first cutting edge, the relief surface defining a plane that is angled relative to a plane which is perpendicular to the longitudinal axis.

* * * * *